US006804905B1

(12) United States Patent
Burger, III et al.

(10) Patent No.: US 6,804,905 B1
(45) Date of Patent: Oct. 19, 2004

(54) PORTABLE SIGN

(76) Inventors: Frank Leo Burger, III, 845 Sylvan St., Warren, OH (US) 44485; Okey F Cobb, Jr., 4147 Masters Rd., Leavittsburg, OH (US) 44430

( * ) Notice: Subject to any disclaimer, the term of this patent is extended or adjusted under 35 U.S.C. 154(b) by 0 days.

(21) Appl. No.: 09/658,358

(22) Filed: Sep. 11, 2000

(51) Int. Cl.[7] ..... G09F 15/00; G09F 19/02; A63H 3/06

(52) U.S. Cl. ..... 40/610; 40/212; 40/412; 40/439; 40/538; 446/179; 446/226

(58) Field of Search ..... 40/212, 214, 412, 40/439, 441, 477, 538, 610; 446/178, 179, 199, 226

(56) References Cited

U.S. PATENT DOCUMENTS

| | | | | | |
|---|---|---|---|---|---|
| 3,159,935 | A | * | 12/1964 | Rubens | 40/415 |
| 3,346,978 | A | * | 10/1967 | Letsinger | 40/214 |
| 3,586,432 | A | * | 6/1971 | Pentes, Jr. | 353/74 |
| 3,892,081 | A | | 7/1975 | Goral | 40/214 |
| 4,145,838 | A | * | 3/1979 | Mason | 40/214 |
| 4,558,862 | A | * | 12/1985 | Kelly | 273/34 R |
| 4,765,079 | A | * | 8/1988 | Takahashi | 40/439 |
| 4,903,958 | A | * | 2/1990 | DiCarlo et al. | 446/220 |
| 4,920,674 | A | | 5/1990 | Shaeffer | 40/412 |
| 5,125,177 | A | | 6/1992 | Colting | 40/610 |
| 5,152,092 | A | | 10/1992 | O'Brien | 40/610 |
| 5,186,675 | A | * | 2/1993 | D. Stoddard | 446/199 |
| 5,293,707 | A | | 3/1994 | Shaeffer | 40/412 |
| 5,379,471 | A | * | 1/1995 | Holdredge | 36/47 |
| 6,148,551 | A | * | 11/2000 | Glass | 40/214 |
| 6,186,857 | B1 | * | 2/2001 | Gazit et al. | 446/226 |
| 6,279,254 | B1 | * | 8/2001 | Gill et al. | 40/412 |

* cited by examiner

*Primary Examiner*—James M. Hewitt
(74) *Attorney, Agent, or Firm*—Brinks Hofer Gilson & Lione; Stephanie J. Felicetty

(57) ABSTRACT

A portable sign which includes a base member having a generally cylindrical rigid lateral wall with an air input opening and an upper opening. An air blower is positioned in the base member, and an elongated display member having a flexible generally cylindrical section extends upwardly from the generally cylindrical rigid lateral wall of the base member. The flexible cylindrical section has a lower open end connecting to a disc shaped cut out in the base member and has a closed top section having an air exit opening. Lettering will be displayed on the flexible cylindrical section.

25 Claims, 8 Drawing Sheets

PORTABLE SIGN

BACKGROUND OF THE INVENTION

1. Technical Field

The present invention relates to signs and more particularly to portable signs. Still more particularly, this invention relates to portable signs which include an inflatable member for displaying information on such signs.

2. Background Information

Signage can be an important factor in the marketing of many types of products and services. One disadvantage, however, to many types of signs is that they are permanently positioned or at least adapted for use over extended periods of time in a single position. In the marketing of many types of products or services, it would be advantageous to move signs or change the content of the message or information on the sign, but most prior art signs are not adapted to such flexibility.

Prior art discloses a number of attempts to increase the usefulness of signage by incorporating an inflatable member in such signs which can be removed to enhance mobility or replaced to change the sign's message or information.

U.S. Pat. No. 3,892,081 to Goral discloses an inflatable portable sign which has a support post with one end sharpened so that it can be inserted into the ground. On the opposite end of the post is a valve to which an air source and an inflatable balloon may be attached. The balloon to be attached may have a message imprinted on it. When the portable sign is used, the post is driven into the ground, the balloon is attached to one side of the valve, the air source is hooked up to the other side of the valve and the balloon is inflated. When the desired diameter of the balloon is attained, the valve is closed and the balloon remains inflated. When the sign is no longer required, the post is pulled from the ground and is moved to a new location. The balloon is inflated and closed off.

U.S. Pat. No. 4,920,674 discloses an inflatable balloon which is contained in a deflated state within a container having a lid. The balloon is attached to an inflating device which is located within the interior of the container. The container has appropriate openings in it to receive air from outside the container to inflate the balloon. When the balloon reaches the desired diameter a mechanism is provided to seal the base of the balloon so that the air is retained therein. The balloon has a message on it and when the lid of the container is removed, the balloon self-inflates. When the balloon is no longer required the power for the inflating device is disconnected and the balloon deflates and can be returned into the container.

U.S. Pat. No. 5,125,177 to Colting discloses a multi-piece inflatable device. The device has a base portion which contains the inflating mechanism. The top portion of the device is an inflatable balloon which is detachable (being attached by a zipper). Alternative top portions displaying different messages or characters can be attached to the base portion. In one version of the invention disclosed in this patent, the base portion of the balloon device is a recess into which the top portion of the balloon can be collapsed for storage.

U.S. Pat. No. 5,152,092 to O'Brien discloses a traffic safety device which includes a see-through, vinyl or rubber-type bag, inflatable to a height of some 4–5 feet and to a width to approximate that of a typical lane of traffic. The inside rear surface of the bag is provided with a reflective material to reflect headlight illumination through any one of a number of highway warning signs that may be draped across the outside front surface of the bag. A pair of elastic straps are stretched to encircle the bag as it is inflated, and automatically pull and guide the bag back into a storage box for the device as the bag is deflated and the straps return to their original lengths.

U.S. Pat. No. 5,293,707 to Shaeffer discloses an arrangement in which the balloon has a pneumatically sealed enclosure for a turbine. The sealed enclosure has an outlet port and which, together with the inlet port, are positioned in relation to the turbine to permit efficient flow of air or other gas into the balloon when it desired to inflate the balloon. The outlet port seals an enclosure when selectively operated to a closed position to prevent leaking of the gas from the inflated balloon.

A need still exists, however, for a sign which can be easily moved from location to location on which a number of different alternate messages can be displayed.

SUMMARY OF THE INVENTION

It is an object of the present invention to provide a sign which can be easily and inexpensively moved form one location to another.

It is another object of the present invention to provide a sign on which the message or information contained on such sign can be easily and inexpensively changed.

It is still another object of the present invention to provide a sign which presents an attractive and novel appearance and which will tend to draw potential customers to the location of the sign.

It is still another object of the present invention to provide a portable sign which may be inexpensively constructed from readily available materials.

The present invention is a portable sign comprising a base member having an air input means and an air output means. A flexible display member having a lower air input connects to the air output means of the base member. There is also an upper air output means on the flexible display means. A means for causing air to flow first through the base member and then through the flexible display member is also included.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

DESCRIPTION OF THE PREFERRED EMBODIMENTS

Figure 1:
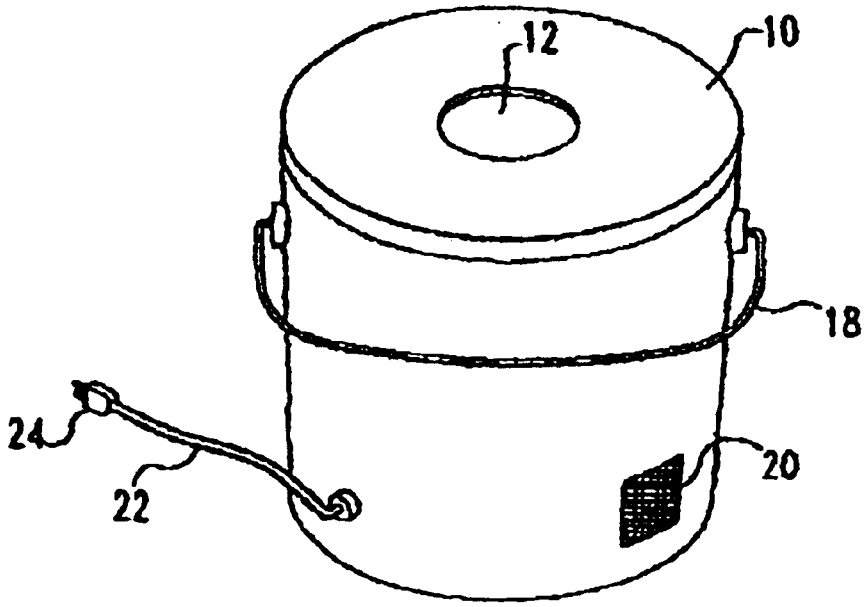
FIG. 1 is a top front perspective view of a portable sign in its collapsed, transportable position representing a preferred embodiment of the sign of the present invention.
Figure 2:
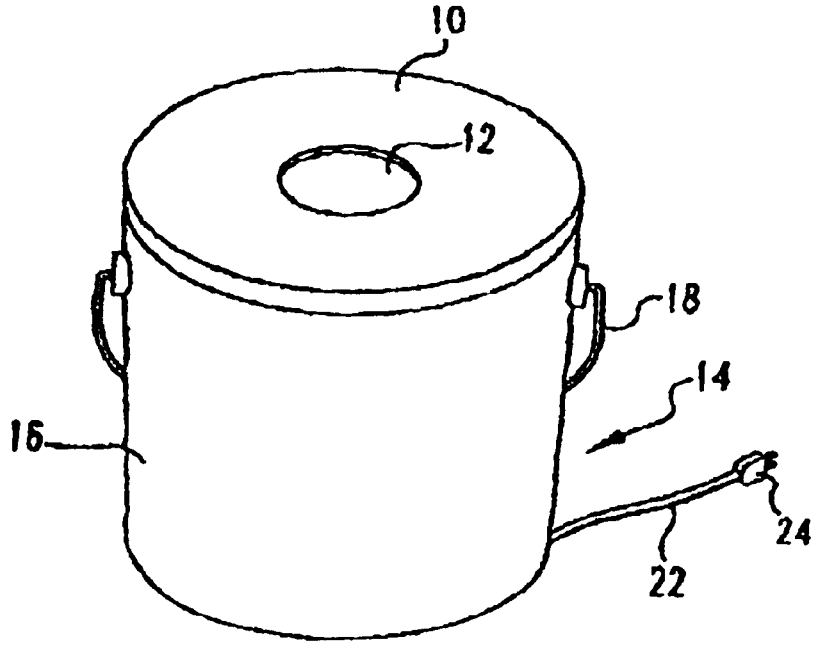
FIG. 2 is a top rear perspective view of the portable sign shown in FIG. 1.
Figure 3:
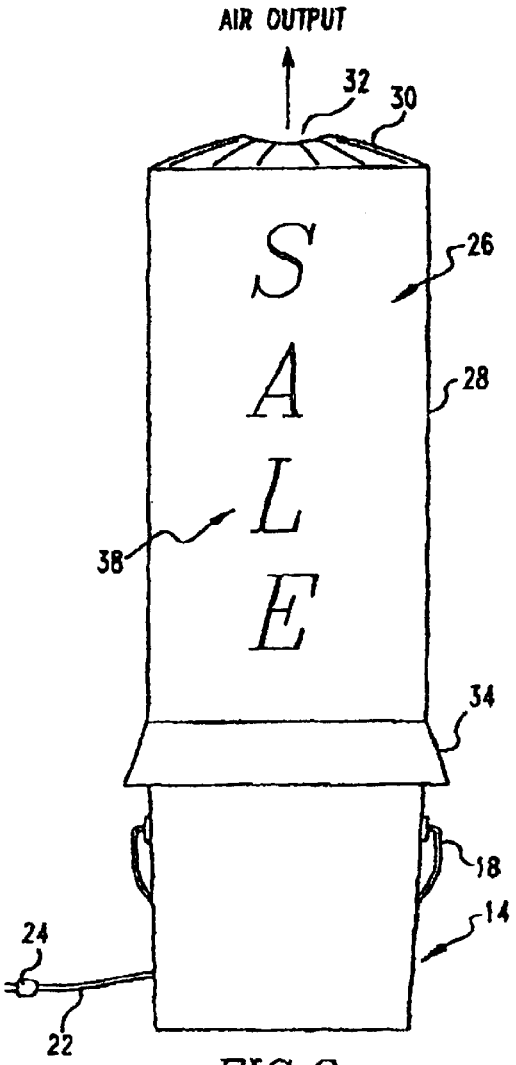
FIG. 3 is a front elevational view of the sign shown in FIG. 1 in its expanded form for use.
Figure 4:
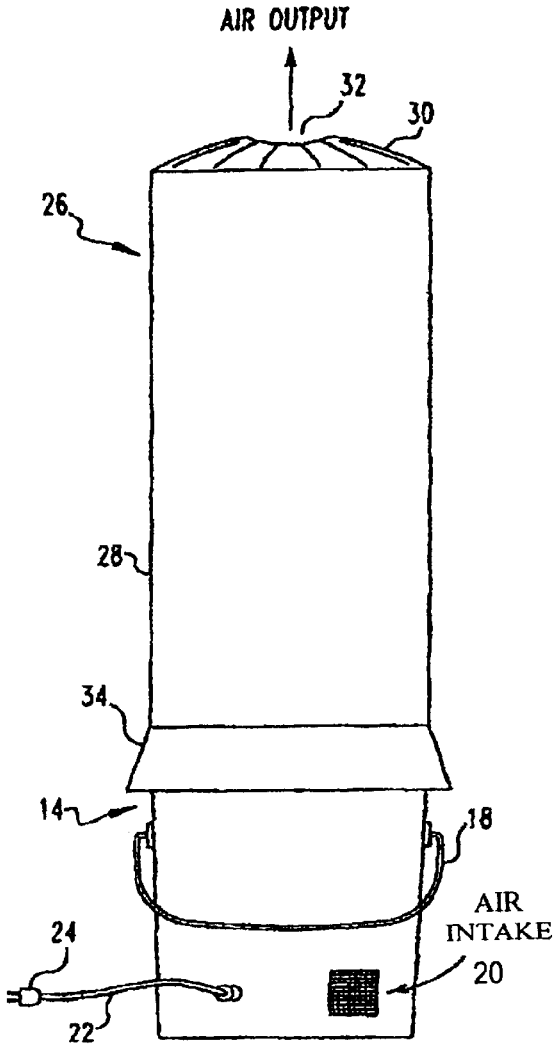
FIG. 4 is a rear elevational view of the expanded sign shown in FIG. 3.
Figure 5:
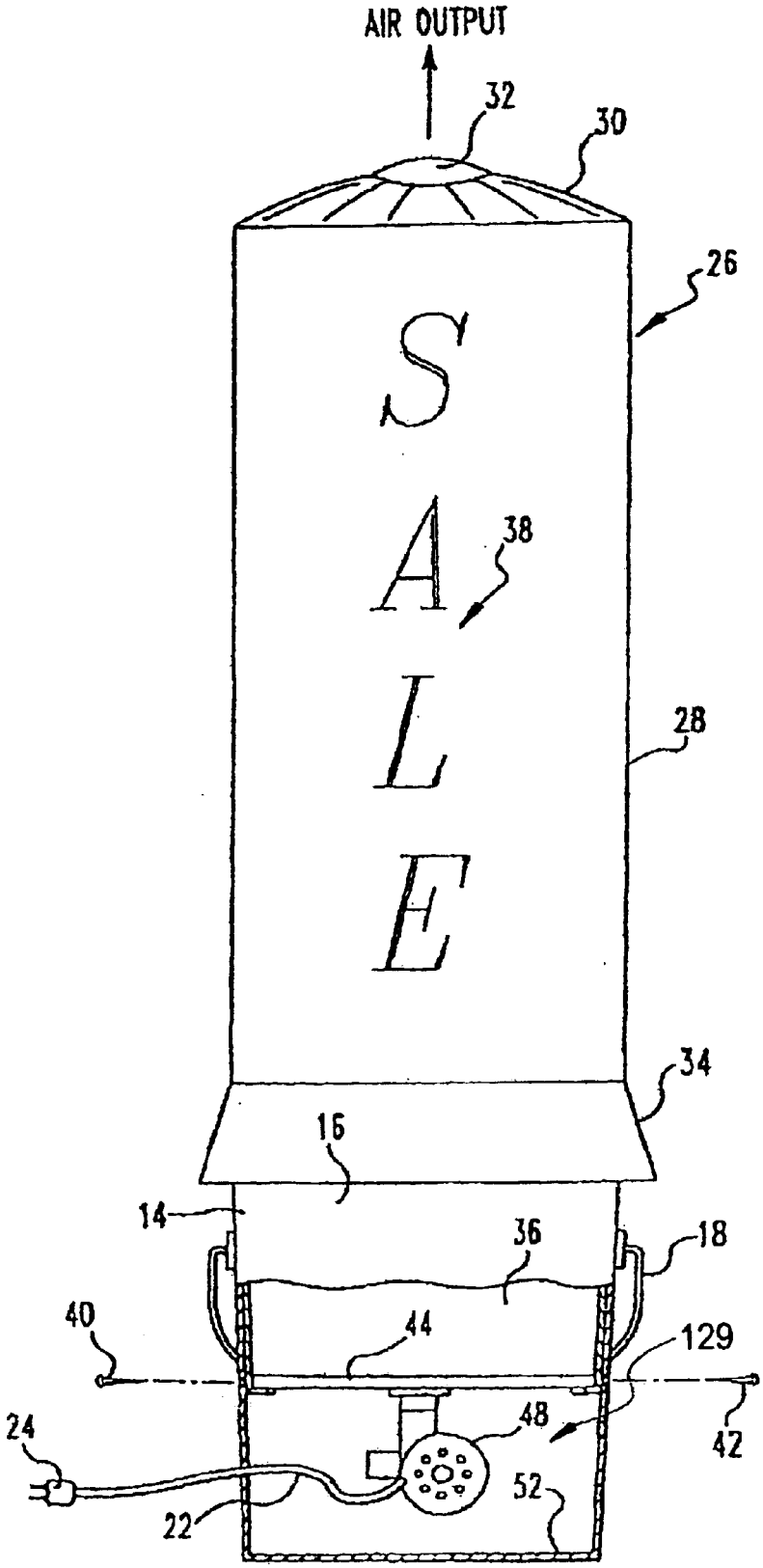
FIG. 5 is a front elevational cutaway view of the expanded sign shown in FIG. 3.
Figure 6:
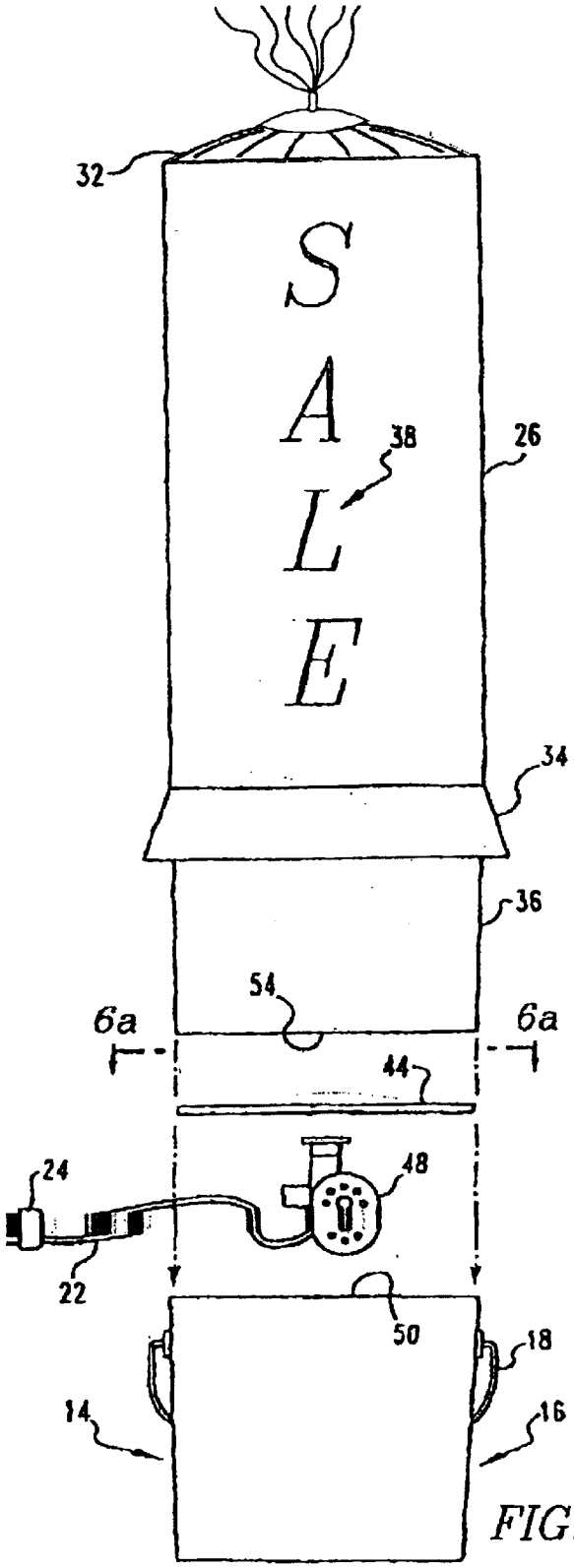
FIG. 6 is an exploded view of the expanded sign shown in FIG. 3.
Figure 6A:
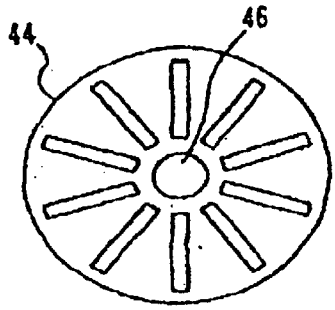
FIG. 6*a* is a plan view from 6*a*–6*a* in FIG. 6.
Figure 7:
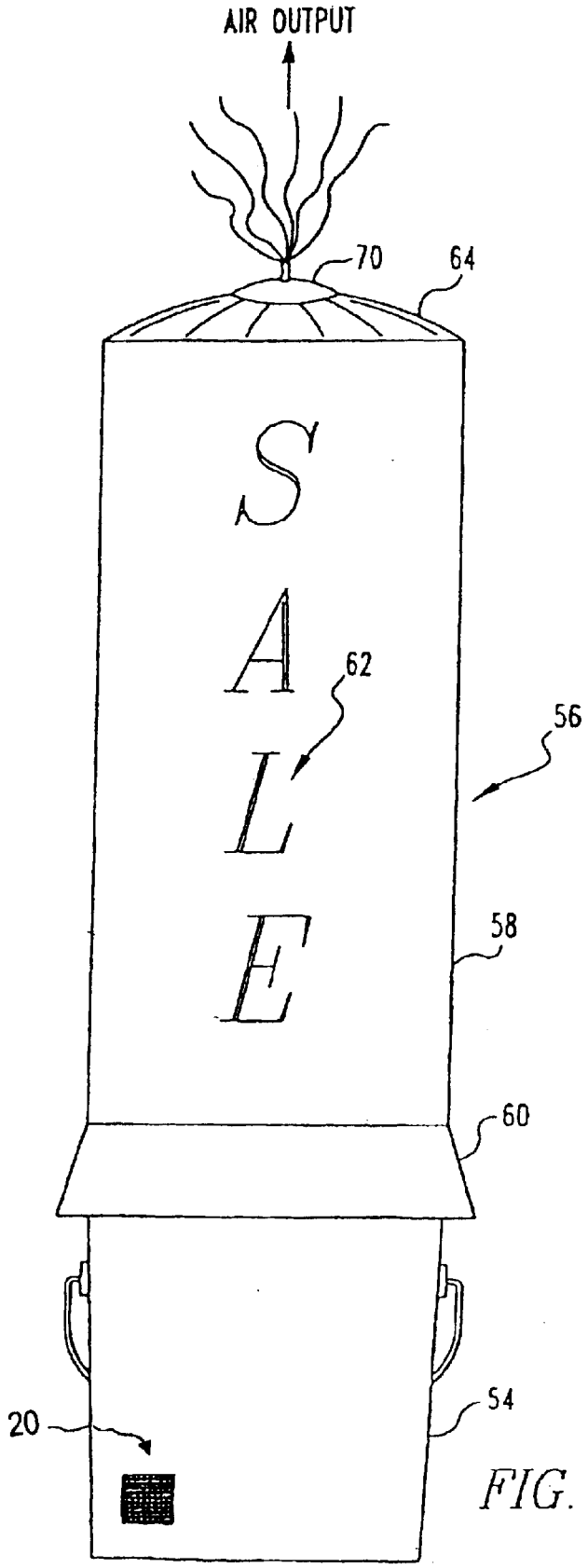
FIG. 7 is front elevational view of an alternate preferred embodiment of the sign of the present invention in its inflated form.
Figure 8:
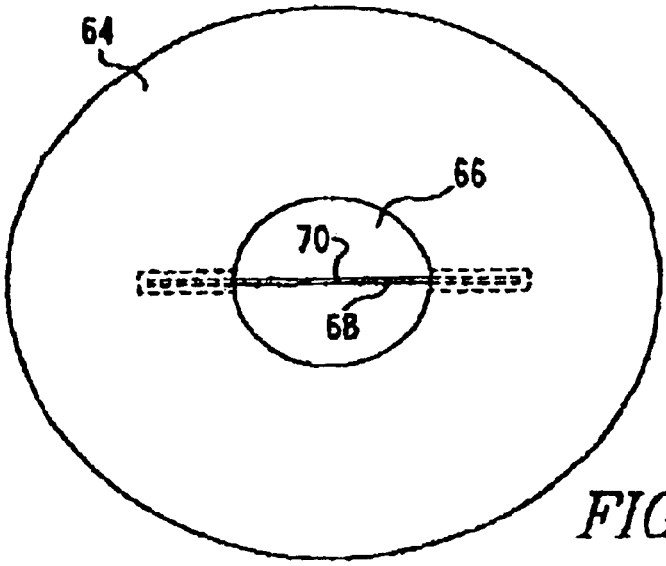
FIG. 8 is a top plan view of the sign shown in FIG. 7.
Figure 9:
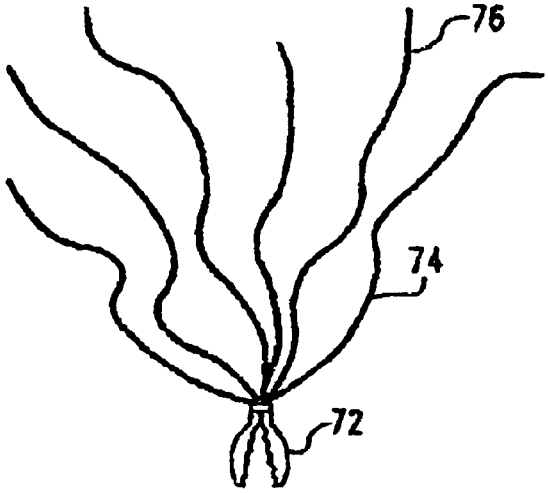
FIG. 9 is a front elevational view of a clip used in the sign shown in FIG. 7.
Figure 10:
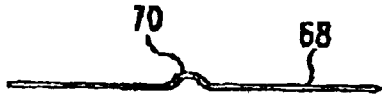
FIG. 10 is a side view of the wire attachment used in the sign shown in FIG. 7.

Referring to FIGS. 1 and 2, in its transportable form, the sign of the present invention includes a plastic lid 10 with a central aperture 12. There is a base member 14 which may be a conventional 5 gallon plastic pail which has a rigid wall 16, a handle 18, and an interior recess 129. On the rear of the base member pail 14, there is an air input opening 20 over which an aluminum wire mesh screen is placed and held at its corners by suitable fasteners (not shown). The sign is also equipped with a preferably ⅜ inch ROMEX 120 volt cable 22 with a terminal plug 24.

Referring to FIGS. 3–6, the sign may be expanded by causing air to flow from the air input opening 20 through the interior. This air flow causes the extension of an inflatable cylindrical display section 26 which includes a flexible peripheral side 28, a circular generally domed top 30 with a central aperture 32 from which air exits in the direction of the air output arrows shown in the drawings. The cylindrical section 26 also includes a lower skirting 34 and a lower extension 36. On the flexible side 28 there is lettering 30 for the display of a particular message as, for example, "SALE" which may be applied by a conventional silk screening method. Fasteners as at screws 40 and 42 are used to attach a horizontal disc shaped cut out 44 to the base member pail 14. Preferably, the screws will be distributed around the entire peripheral edge of the disc shaped cut out 44 and will be screwed directly through the right wall 16 of the base member 14 and then into the disc shaped cut out 44. This disc shaped cut out 44 has a central aperture 46 which is superimposed over a blower 48 positioned inside the base member 14. The base member 14 has an open top 50, which serves as the base member's air output means, and a solid bottom 52. The cylindrical section 26 and its flexible side 28 may either be a nonporous polymer film material, a porous textile material, or a composite of a nonporous polymer film and a porous textile material. Preferably this material would be a lightweight nylon denier tackcloth with a ¾ ounce urethane coating that protects the material against water absorption. This material may be sewn together with one seam on its rear side. The round top 30 piece of material is then sewn onto the top of the inflatable cylindrical section 26 to retain air. The cylindrical section 26 has an opened bottom end 54, which serves as the flexible display member's lower air input means and is placed over the sides of the disc shaped cut out 44 so that the lower extension 36 of the cylindrical section 26 is interposed between the peripheral edge of the disc shaped cut out 44 and the rigid wall 16 of the pail 14 and is folded under the disc shaped cut out 44 and is fixed to the bottom surface of the disc shaped cut out 44 by suitable fasteners (not shown). The lower extension 36 may also be provided with suitable apertures (not shown) to allow screws as at screws 40 and 42 to pass through it or alternately the lower extension 36 may be perforated by screws as at screws 40 and 42. The skirting 34 is made of the same material as the flexible side 28 and is preferably made of two separate pieces, one going around the front of the cylindrical section 26 and the other going around the rear. These two pieces would preferably meet on the sides and slightly overlap. The skirting 34 hides any underlying surface features on the base member pail 14 such as ribs (not shown) when the flexible cylindrical section 26 is fully inflated. The skirting 34 also channels water away from the interior of the bucket in the event any moisture is present. The skirting 34, which is part of the inflatable cylindrical section 26, is also pushed down inside the base member pail 14 into the recess of the base member pail 129 when not in use and may not be adjusted to be straightened once the inflatable cylindrical section 26 exits the bucket when in operation. The blower is preferably a DAYTON shaded pole blower 115 volt, Model 4C 443, 1/70 UP, 2870 RPM. type U21B.

Referring to FIGS. 7–10, in an alternate embodiment, there is a base member 54 which may be a pail. An inflatable cylindrical section 56 extends upwardly from the base member 54 and includes a flexible side 58, a skirt 60 with lettering 62. The inflatable cylindrical section 56 also includes circular top 64 with a central aperture 66. A central wire 68 is sewn into the circular top 64 so that this wire 68 bisects the central aperture 66. There is a bend 70 in the wire. An alligator clip 72 is attached to the wire 68 on the bend 70. A plurality of streamers as at streamers 74 and 76 are attached to the alligator clip 72. A blower (not shown) is positioned in the interior of the base 54. In the manner described above in connection with FIGS. 1–6, the blower withdraws air from an air opening in the base 54 and causes that air to flow upwardly through the inflatable cylindrical section 56 and then continuously outwardly through the central aperture 66 in the direction of the air output arrow to maintain the inflatable cylindrical section 56 in an upright position so as to display the lettering 62 on the flexible side 58 of the inflatable cylindrical section 56.

Figure 11:
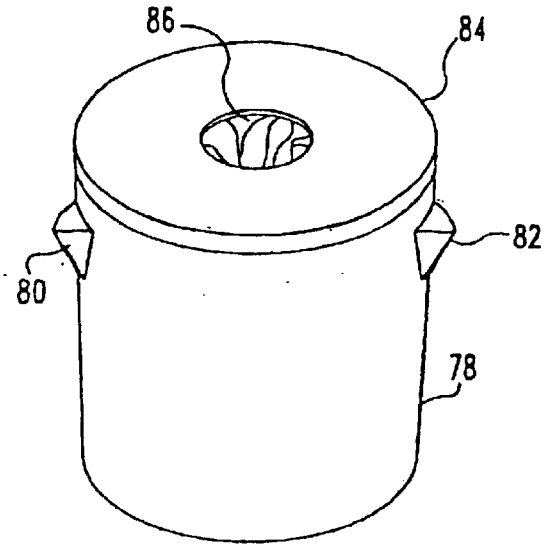
FIG. 11 is a top front perspective view of a sign in its collapsed state representing another alternate embodiment of the present invention.
Figure 12:
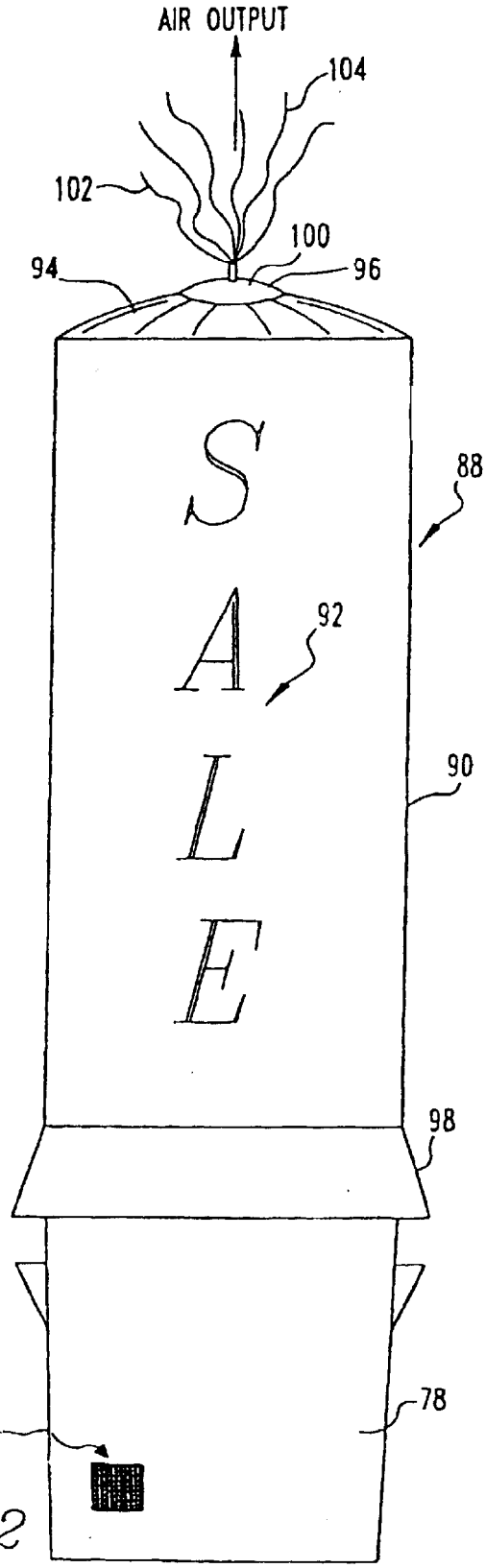
FIG. 12 is a front elevational view of the sign shown in FIG. 11 in its inflated state.

Referring to FIGS. 11–12, another embodiment of the sign is shown in which there is a base member 78 which may be constructed from a 32 gallon trash container as would, for example, be a RUBBERMAID trash container. This base member 78 has handles 80 and 82 and a lid 84 with a central aperture 86. Referring particularly to FIG. 12, in this embodiment a blower (not shown) which may be a DAYTON shaded pale blower, 115 volt, Model 4C 443, 1530 RPM, 465 CFM positioned in the base 78 displays the inflatable cylindrical section 88 which has a flexible side 90 with lettering 92. This inflatable cylindrical section 88 also has a circular generally domed top 94 with a central aperture 96 which serves as an air output in the direction of the arrow shown in FIG. 12. As with the other embodiments discussed above, the inflatable cylindrical section 88 also includes a lower skirting 98. A wire 100 bisects the top central aperture 96 and streamers as at streamers 102 and 104 are attached to the wire 100 in the way described in connection with the embodiment in FIGS. 7–10. The blower (not shown) contained in the base member 78 draws air from an input aperture (not shown) in the base member 78 and causes that air to flow upwardly through the base member 78 and the inflatable cylindrical section 88 and exit through the central aperture 96 in the direction of the air output arrow to cause the streamers as at 102 and 104 to draw the attention of potential customers toward the sign.

Figure 13:
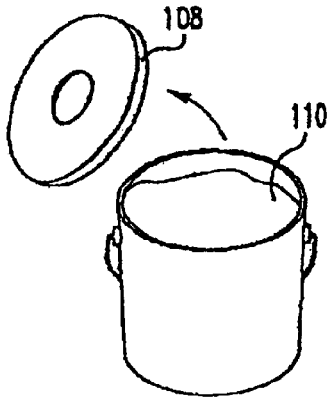
FIGS. 13–18 are front elevational views of the sign shown in FIG. 1 showing sequential steps in the method for inflating the sign.
Figure 14:
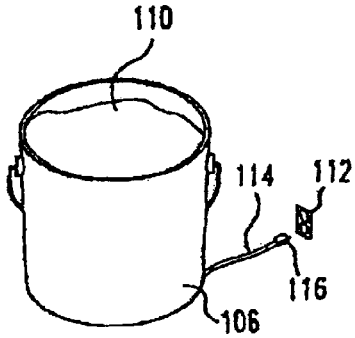
Figure 15:
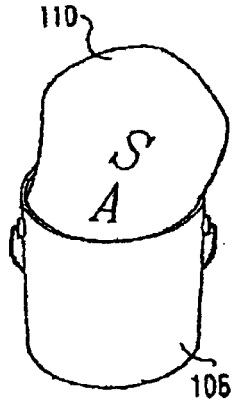
Figure 16:
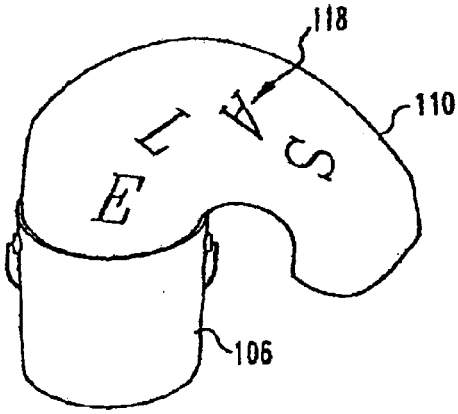
Figure 17:
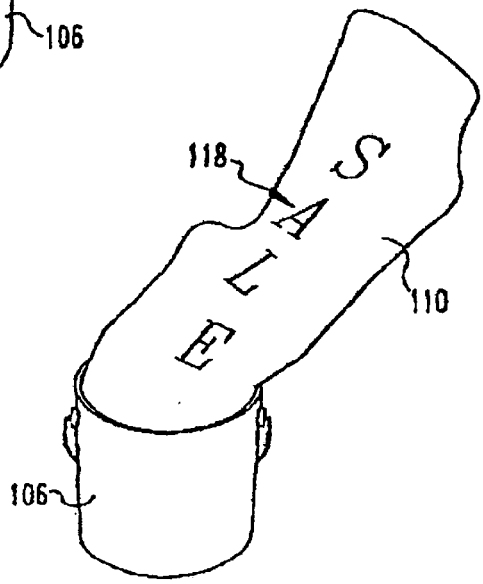
Figure 18:
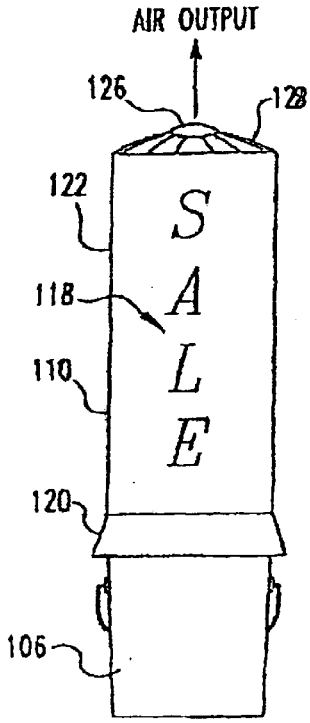

A method of using the sign of the present invention to display a message is further disclosed in FIGS. 13–18. The first step in the method is shown in FIG. 13 in which the base member 106 which may be a pail is positioned in a place where a sign is desired, and the rigid lid 108 is removed therefrom to display the collapsed flexible cylindrical section 110 inside the base member 106. As is shown in FIG. 14, the base member 106 with the interior uninflated cylindrical section 110 is connected to an electrical receptacle 112 by means of a power cord 1 14 and a socket 116. As is shown in FIG. 15, the connection between the socket 116 and receptacle 112 results in the activation of a blower (not shown) in the base member 106 and the beginning of the inflation of the inflatable cylindrical member 110. As is shown in FIG. 16, the blower (not shown) in the base member 106 continues to operate to further inflate the cylindrical member 110 to display lettering 118. As is shown in FIG. 17, further operation of the blower (not shown) in the base member 106 results in further inflation of the cylindrical section 110 to cause the cylindrical section to approach vertical position and further display the lettering 118. As is shown in FIG. 18, still further continued operation of the blower results in the cylindrical section 110 achieving a vertical position in which the circular top 128 is slightly domed and air continues to flow outwardly from the top aperture 126 to maintain that position. It will be understood that once this vertical inflated position has been achieved for the cylindrical section 110, it will be maintained as long as the flow of air into the base member 106 and through the base member 106 and the cylindrical section 110 and exiting the top aperture 126 in the direction of the air output arrow is maintained by means of operation of the blower (not shown). As an alternative, the blower (not shown) may be selectively activated and deactivated, and when the blower is activated the flexible display member is inflated, as shown in FIG. 18, and when the blower is deactivated the flexible display member is collapsed, as shown in FIG. 14.

It will be appreciated that a portable sign has been described which may be easily transported from one site to another. The message displaying element on this sign may also be easily changed, and the sign may be inexpensively and efficiently manufactured from readily available parts.

Accordingly, the improved PORTABLE SIGN apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the PORTABLE SIGN is constructed and used, the characteristics of the construction, and the advantageous new and useful results obtained; the new and useful structures, devices, elements, arrangements, parts, and combinations are set forth in the appended claims.

What is claimed is:

1. A portable sign comprising:

a base member having an air input means and an air output means;

an inflatable, flexible display member having a lower air input means adjacent the air output means of the base member and an upper air output means;

means for causing air to flow first through the base member and then through the flexible display member; and a disc having a central aperture disposed within the base member and secured to the base member about the inner periphery of the base member, wherein the inflatable, flexible display member is secured about the outer periphery of the disc.

2. The sign of claim 1 wherein the base member is generally cylindrical.

3. The sign of claim 2 wherein the base member has an interior recess and an open top.

4. The sign of claim 3 wherein the base has a rigid sidewall and a rigid floor.

5. The sign of claim 4 wherein the air input means is an aperture in the rigid sidewall of the base member.

6. The sign of claim 1 wherein the air output means is an open top of the base member.

7. The sign of claim 1 wherein the flexible display member is generally cylindrical.

8. The sign of claim 7 wherein the flexible display member extends vertically from the base member.

9. The sign of claim 1 wherein the flexible display member is comprised of a nonporous material.

10. The sign of claim 9 wherein the flexible display member is a polymer film material.

11. The sign of claim 1 wherein the flexible display member is comprised of a porous material.

12. The sign of claim 11 wherein the flexible display member is a textile material.

13. The sign of claim 1 wherein the flexible display member is comprised of a composite of a textile material and a polymer film material.

14. The sign of claim 1 wherein the flexible display member has surface lettering.

15. The sign of claim 1 wherein the means for causing air to flow is an air blower.

16. The sign of claim 14 wherein the air blower is interiorly positioned in the base member.

17. The sign of claim 1 wherein the means for causing air to flow through the base member and then through the flexible display member may be selectively activated and deactivated, and when said means for causing air to flow is activated the flexible display member is inflated, and when said means for causing air to flow is deactivated the flexible display member is collapsed.

18. The sign of claim 15 wherein a rigid lid is superimposed over the flexible display member when said flexible display member is collapsed.

19. The sign of claim 16 wherein air continuously flows through the flexible display member when said flexible display member is inflated.

20. The sign of claim 1 wherein the base member is a pail.

21. The sign of claim 1 wherein the base member is a generally cylindrical trash container.

22. A portable sign comprising:

a base member having an air input means and an air output means;

an air blowing means positioned in the base member;

an inflatable, flexible display member having a lower air input means connecting to the air output means of the base member; and a disc having a central aperture disposed within the base member and secured to the base member about the inner periphery of the base member, wherein the inflatable, flexible display member is secured about the outer periphery of the disc.

23. A portable sign comprising:

a base member having a generally cylindrical rigid wall with an air input opening and an open upper end and an interior;

an air blowing means positioned in the interior of the base member;

an elongated display member having an inflatable, flexible cylindrical section with a lower skirt and an upper closed section, wherein said lower skirt section peripherally overlaps the cylindrical rigid wall, and the flexible cylindrical section extends upwardly from the cylindrical rigid wall of the base member and has an upper closed section with a central air exit opening; and a disc having a central aperture disposed within the base member and secured to the base member about the inner periphery of the base member, wherein the inflatable, flexible cylindrical section is secured about the outer periphery of the disc.

24. A method for displaying a portable sign comprising the steps of:

providing a base member having an air input means and an air output means;

positioning an inflatable, flexible display member adjacent the air output means of the base member, wherein the flexible display member has a lower air input means and an upper air output means, and the base member contains a disc having a central aperture disposed within the base member and secured to the base member about the inner periphery of the base member, wherein the inflatable, flexible display member is secured about the outer periphery of the disc; and causing air to flow into the base member, through the flexible display member's lower air input means, and then through the flexible display member so as to exit said flexible display member through said upper air output means so as to cause said flexible display member to be at least partially inflated.

25. The method of claim 24 wherein air is caused to continuously flow through the base member and the flexible display member and the upper air output means for about as long as the portable sign is desired to be displayed.

* * * * *